United States Patent [19]

Bergstresser

[11] 3,939,814

[45] Feb. 24, 1976

[54] DEVICE FOR PROLONGING IGNITION SPARK

[75] Inventor: Ralph E. Bergstresser, Hollywood, Calif.

[73] Assignee: Energy Innovations, Newbury Park, Calif.

[22] Filed: Jan. 10, 1975

[21] Appl. No.: 539,937

[52] U.S. Cl. ..... 123/148 A; 123/148 D

[51] Int. Cl.[2] ..... F02P 1/00

[58] Field of Search ..... 123/148 D, 148 A, 169 PA

[56] References Cited

UNITED STATES PATENTS

| | | | |
|---|---|---|---|
| 1,441,212 | 1/1923 | Cardwell | 123/148 A |
| 1,514,496 | 11/1924 | Witter | 123/148 A |
| 1,521,178 | 12/1924 | Fulgora | 123/148 A |
| 1,903,654 | 4/1933 | Oestricher | 123/148 A |
| 2,185,938 | 1/1940 | Crawford | 123/148 A |
| 2,467,725 | 4/1949 | Berkey et al. | 123/148 A |
| 2,736,760 | 2/1956 | Kane, Jr. | 123/148 A |
| 2,841,629 | 8/1958 | Autrey | 123/148 A |
| 2,899,478 | 8/1959 | Schramm | 123/148 A |

*Primary Examiner*—Wendell E. Burns
*Assistant Examiner*—James W. Cranson, Jr.
*Attorney, Agent, or Firm*—Robert E. Geauque

[57] ABSTRACT

A spark prolonging device having a winding on an electrically inert core and connected at one end to the secondary coil of an ignition system and at the other end to the distributor, a first portion of the winding comprised of coils spaced on said core and a second portion of the winding comprised of tightly wound coils; the second winding portion consisting of three sections with the direction of winding reversed between the first and second sections and between the second and third sections and the second section having approximately twice as many coil turns as said first and third sections.

15 Claims, 19 Drawing Figures

Fig. 1.
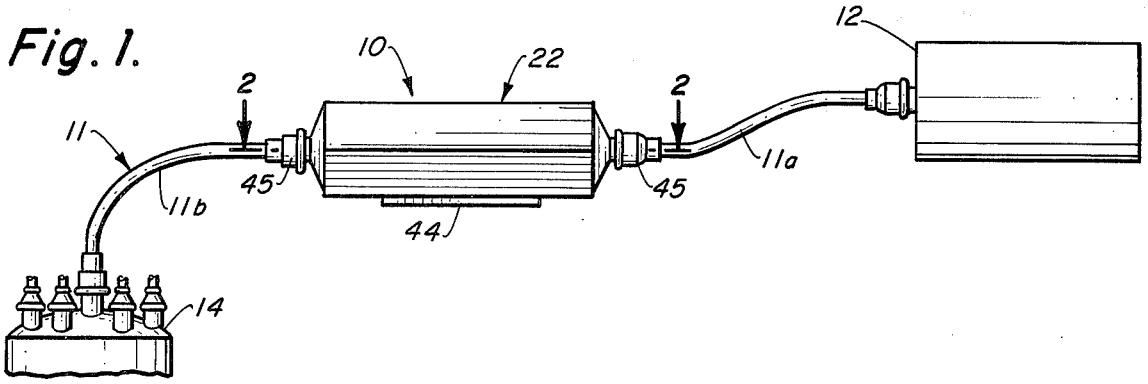
Fig. 2.
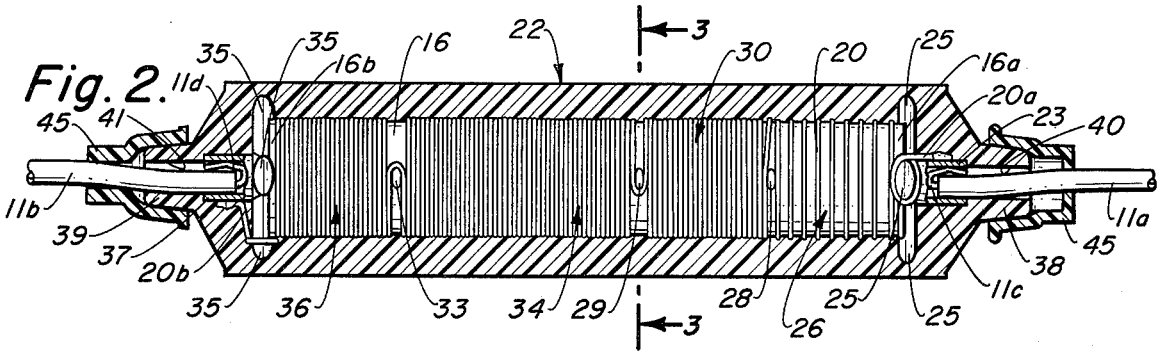
Fig. 4.
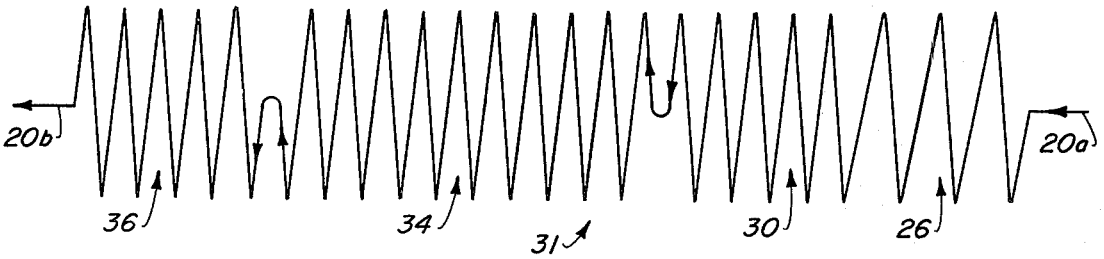
Fig. 18.
| Car NO. | CAR MAKE | YR | Mileage | H. P. Incr. G.E.U. | % H.P. Incr. | Mi Pr. Gal. Incr. | % Mi Pr. Gal. Incr. | Perform Impr. N | F | G | E |
|---|---|---|---|---|---|---|---|---|---|---|---|
| 1 | B.M.W. | 74 | 53,000 | 3 | 4.6 | 1.8 | 9 | | | X | |
| 2 | LCon Mark 3 | 69 | 103,000 | 15 | 13 | 2.0 | 14 | | | | X |
| 3 | LCon Mark 4 | 72 | 32,000 | 10 | 10 | 1.2 | 9 | | | | X |
| 4 | Cadillac | 65 | 94,000 | 3 | 2 | N.R. | N.R | | X | | |
| 5 | Mazda XR2 | 71 | 45,000 | 2 | 4 | 2 | 9 | | | X | |
| 6 | Chev,ElCam | 67 | 113,000 | 11 | 11 | 4.6 | 36 | | | | X |
| 7 | Datsun P.U. | 70 | 85,000 | 5 | 11 | 5 | 21 | | | | X |
| 8 | Toyota L.C. | 73 | 1,300 | 2 | 4 | 3.8 | 26 | | | | X |
| 9 | Cadillac | 68 | 80,000 | 0 | 0 | N.R. | N.R. | | X | | |
| 10 | Buick Riv. | 65 | 110,000 | 4 | 5 | 1.5 | 12 | | | X | |
| 11 | Olds | 70 | 69,000 | 16 | 20 | 4 | 25 | | | | X |
| 12 | Matador 360 | 71 | 74,000 | 7 | 10 | 1.5 | 8 | | | X | |
| 13 | LCon Sedan | 67 | 63,000 | 8 | 7 | 1.8 | 13 | | | | X |
| 14 | Pont. F-Bird | 74 | 13,000 | 3 | 4 | N.R. | N.R. | | X | | |
| Average Increases | | | | 6 H.P. | 7.3% | 2.6 | 16% | | | | |
N - None G - Good
F - Fair E - Excellent
NR - No Report

DEVICE FOR PROLONGING IGNITION SPARK

BACKGROUND OF THE INVENTION

The standard ignition system which has been utilized for automobile internal combustion engines consists of an ignition coil connected to the distributor which has a rotary switch connected sequentially to the various spark plugs. The ignition coil is a transformer in which the primary winding is connected to the battery and the secondary winding is connected to the distributor. When the breaker points in the distributor disrupt the voltage in the primary coil, a high voltage surges through the secondary coil. These breaks in the primary current are timed to take place near the top of each pistons compression stroke. A condenser across the breaker points prevents sparking across the points and helps provide a clean electrical break resulting in a high voltage spark in the cylinder. The voltage from the secondary of the ignition coil must be great enough to produce a spark across the spark plug electrodes which is hot enough to ignite the highly compressed gasoline-air mixture in the cylinder.

Ignition modifying devices have been previously proposed for insertion in the electrical line between the secondary winding of the coil and the distributor, such as described in U.S. Pat. Nos. 2,736,760 and 2,841,629. However, these devices do not utilize a structure in which the ignition coil secondary is connected to a spark prolonging device wound about an electrically inert material, in reversed directions in order to increase the effective time of the spark.

SUMMARY OF THE INVENTION

The device of the present invention is connected in the standard ignition system between the ignition coil secondary winding and the rotary switch of the distributor which controls the application of high voltage energy to the spark plugs. The presence of the device causes a prolonged flow of coil energy through the spark gap which helps to correct erratic combustion and misfiring in the firing chamber and increases engine performance, thus resulting in high gas mileage and greater horsepower. As the miles of engine operation with standard ignition increase, carbon accumulates due to inadequate spark, fouled plugs, sticky valves, etc., and each misfire results in more carbon deposits in each cylinder accompanied with increased loss of power and engine emissions. The spark prolonging device of this invention also has the effect of removing carbon which has deposited on the plugs and valves.

The spark prolonging device consists of a winding structure on a solid rod or core of electrically inert material, such as polyethylene plastic. The winding is continuous but is divided into distinct portions. The first portion is connected to the secondary of the ignition coil and consists of a relatively few turns of wire which are somewhat spaced apart. This first portion is referred to as the primary of the device. The winding then continues on the core to form a second portion which is divided into three distinct sections collectively designated as the second portion. In these sections the wire coils are wound closely adjacent one another and the direction of winding is reversed between the first and second sections and between the second and third sections. Also, the number of coils in the first and third sections are approximately equal and the number of coils in the second section is approximately double the number of coils in the first and third sections.

The connection of the secondary of the ignition coil to the spark prolonging device of this invention can be compared to a Telsa high frequency swing-circuit, which consists of a basic iron-core coil (ignition coil) with the secondary winding connecting with another coil structure without an iron core (spark prolonging device). While the discharge voltage level at which the plugs fire is about the same whether or not the spark prolonger is utilized in the ignition circuit, the longer time interval during which the spark is maintained by the device of the present invention results in more complete and efficient burning of the fuel-air mixture. When the voltage firing level is the same, the longer spark time produced by this invention results in increased total electrical energy being imparted to the fuel mixture.

BRIEF DESCRIPTION OF THE DRAWINGS

FIG. 1 is a schematic illustration of the spark prolonging device of the present invention connected in a standard ignition systems between the ignition coil and the distributor;

FIG. 2 is a horizontal section along line 2—2 showing the winding structure of the invention;

FIG. 4 is a schematic illustration of the first portion and the sections of the second portion of the winding structure of the invention;

FIG. 18 is a chart of test results obtained in a number of different engines and showing the increase in horsepower and miles/gallon obtained by use of the device of the present invention.

DETAILED DESCRIPTION OF THE PREFERRED EMBODIMENT

Figure 6:
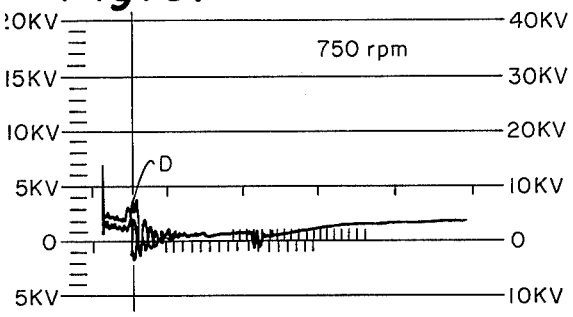
FIGS. 6, 7 and 8 are actual oscilloscope diagrams of an engine equipped with standard ignition operating at 750 rpm, 1800 rpm and 3500 rpm, respectively.

In FIG. 1, the spark prolonging device 10 of the present invention is shown connected in electrical line 11 leading from the secondary winding of the ignition coil 12 to the distributor 14. The device 10 consists of solid core 16 fabricated of an electrically inert material, such as plastic. Section 11*a* of line 11 connects the secondary winding (not shown) of coil 12 with end 20*a* of wire 20 which is wound on the core 16 and then covered with plastic housing 22. The insulation on the end 20*a* is first removed and the end is then soldered to a conducting socket 23. The insulation at the end of line section 11*a* is removed so that the non-insulated end 11*c* can be doubled back to form a spring which is insertable into the socket 23 to make electrical contact. Four plastic posts 25 extend from the core end 16*a* at ninety degree intervals and the wire end 20*a* wraps around one of the posts 25 before it is wound on the core 16.

From post 25, wire 20 then wraps around the core 16 in a counterclockwise direction as viewed from the right side of FIG. 2 to form the first winding portion 26 designated as the first portion of the winding structure of the invention. The wire 20 is preferably 22 gauge Formvar insuled magnetic wire. In the first winding portion, the coils are spaced apart approximately 0.078 inches and at the end of the first portion, the wire 20 passes projection 28 which extends outwardly a short distance from the core surface.

The wire continues to wind in side by side coils in the same direction over the core length between projection 28 and the next projection 29. This section 30 of the winding constitutes the first section of the second winding portion 31. The winding 20 reverses direction around projection 29 and continues in side by side coils between projection 29 and the next projection 33 to form second section 34 of the second winding portion 31. The winding 20 again reverses direction around projection 33 and continues in side by side coils between projection 33 and one of posts 35 spaced 90° apart at the end 16*b* of core 16, thereby forming the third section 36 of the second winding portion 31. The insulation on end 20*b* of the wire 20 is removed and after the wire wraps around one post 35, the non-insulated end is soldered to conducting socket 37. The insulation at the end of line section 11*d* is removed and the end 11*d* is doubled back to form a spring which can be inserted into socket 37 for electrical connection. The opposite end of line section 11*b* is connected to the distributor in the usual manner. After the wire 20 has been wound upon core 16, the complete core is encapsulated in plastic casing 22. End projections 38 and 39 of the casing contain passsages 40 and 41, respectively which lead to and contain sockets 23 and 37, respectively.

In order to install the device 10, the casing 22 can be mounted on any suitable support available in the vicinity of the distributor by means of an adhesive pad 44 and the spring ends of line sections 11*c* and 11*d* are inserted through openings 40 and 41 into sockets 23 and 37 in order to make contact with the opposite ends 20*a* and 20*b* of wire 20. A rubber boot 45 can be slid over each of the end projections 38 and 39 of the casing to aid in maintaining the line connections.

In the preferred form of the device 10, the core is 1¼ inches in diameter and is approximately 6½ inches long. The first portion 26 contains fifteen turns and covers approximately one and one-fourth inch of the core and the spacing between the coils is approximately 0.078 inches. As previously stated, 22 gauge wire is preferred for wire 20. The first and third sections 30 and 36 of the second winding portion 31 each contain forty-eight turns and extends approximately 1¼ inch along the core 16. The second section 34 contains ninety-six turns and extends approximate 2½ inches along the core. As is apparent, the number of turns in the second section of the second winding portion is twice the number of turns in the first and third sections of the second portion. Also, the length of the first portion 26 along the coil is approximately equal to the length of the first and third sections 26 and 36 of the second portion 31. The reversal of direction of the wire 20 occurs between the first and second sections and between the second and third sections of the second winding portion 31.

Figure 5:
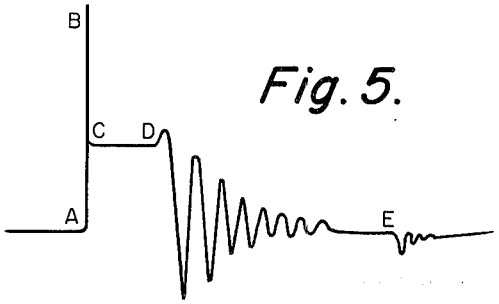
FIG. 5 is an illustration of a typical diagram of ignition voltage vs. time of the ignition spark as observed on an oscilloscope.

FIG. 5 is a typical display of firing voltage vs. time for a single spark plug in a standard ignition system as observed on an oscilloscope. The first part is the almost vertical line A–B, which represents an increase in secondary voltage from zero to the value required to break down the spark-gap between the plug electrodes and the gap between the distributor rotor and the cap insert. This would occur at the instant the distributor contacts separate. Once the spark plug gap has been ionized, less voltage is required to maintain current flow through the ionized gap, than was required to initially break down the gap. After the voltage rises from A to B and the spark plug gap ionizes, the voltage immediately decreases to the value shown at C. A voltage from C to D, called the spark-line, then prevails for approximately 0.002 seconds to maintain current flow through the ionized gap. A typical value of the spark-line voltage may be 5,000 volts.

During the time interval from C to D energy in the coil is being dissipated as it maintains current flow across the two plug electrodes. At the point D, the spark terminates because insufficient energy remaining in the coil is then dissipated throughout the circuit in the form of a damped oscillation between points D and E. As the current in the ignition coil flows first in one direction and then in the other, due to the inductive-capacitive effect of the coil and the distributor-capacitor, the secondary voltage appears as an alternating voltage that decreases in magnitude between points D and E. The last section from E to A represents the dwell section, or the length of time during which the distributor contacts are closed. The contacts close at E at which time a comparatively small voltage is induced in the secondary winding, this voltage then oscillates and decreases in value until at point A, the secondary voltage is zero. When the contacts open at A, the cycle then repeats to fire the next spark plug. A complete cycle on an 8-cylinder engine with 3,000 rpm would required .005 seconds.

Figure 7:
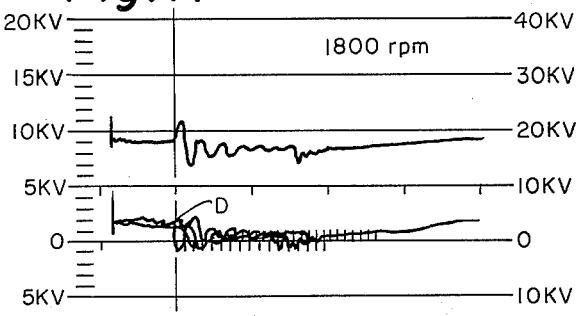
Figure 9:
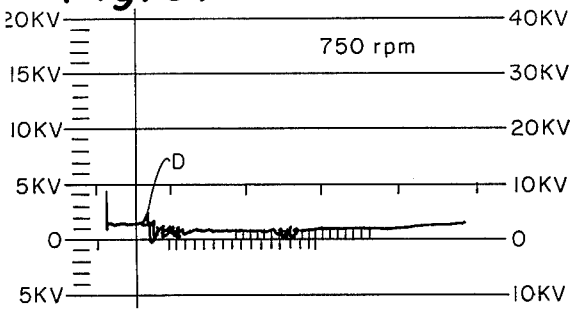
FIGS. 9, 10 and 11 are actual oscilloscope diagrams of the same engine equipped with a preferred form of the invention and operating at 750 rpm, 1800 rpm, and 3500 rpm, respectively.
Figure 10:
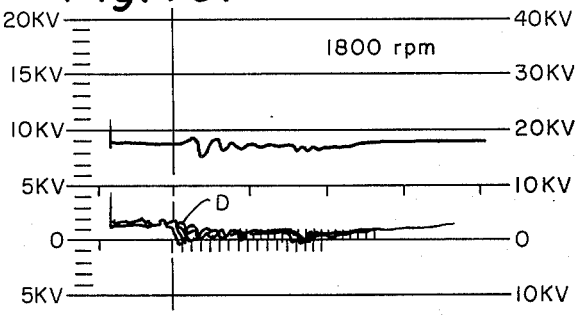
Figure 8:
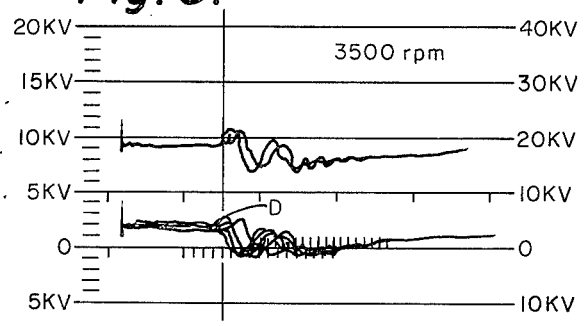
Figure 3:
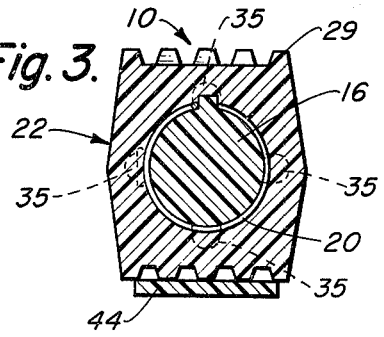
FIG. 3 is a vertical section along line 3—3 of FIG. 2.
Figure 11:
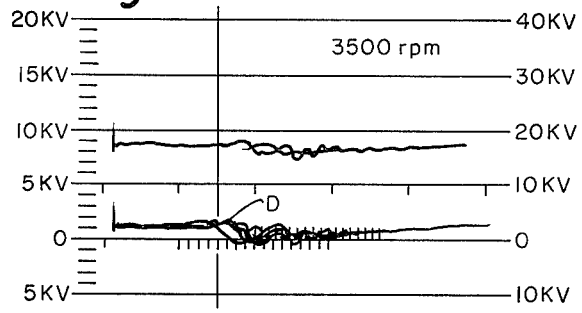

FIGS. 6 and 9 are displays of the oscilloscope diagram for an engine running at 750 rpm without the device 10 installed and with the device 10 installed, respectively. In a similar manner, FIGS. 7 and 10 are oscilloscope displays of the same engine running at 1,800 rpm with the device 10 installed for the display of FIG. 10 and FIGS. 8 and 11 are displays of the same engine running at 3,500 rpm; FIG. 11 being with device 10 installed. The engine tested was a 1969 Continental Mark III with 100,000 miles and was the same car as car No. 2 in the Chart of FIG. 18. These figures illustrate that the presence of device 10 extended the length of line C–D during which the plug fires and this resulted in a fifteen percent horsepower increase and a fourteen percent increase in gas mileage. At each speed, the time C–D of the spark was prolonged at least one unit on the time scale, the effect being most pronounced at 3,500 rpm when the prolongation was about two time units. While the curves indicate a slightly lower voltage level over the section C–D of the curves when device 10 is installed, the area under the line sections C–D with device 10 installed, (FIGS. 9, 10 and 11) appear to be about equal to the same area in FIGS. 6, 7 and 8 without the device installed at 750 and 1,800 rpm, and to be greater at 3,500 rpm. The vertical lines in FIGS. 9, 10 and 11 correspond to the time value of point D in FIGS. 6, 7, and 8, respectively.

The test results depicted in FIGS. 6–11 demonstrate that device 10 extends the spark line (C–D), thus indicating a longer prevailing voltage than occurs in the standard system without device 10. This has the effect of providing a more positive ignition of the fuel-air mixture, better flame propagation and prolonged combustion. The result is an increase in horsepower and a decrease in unburned fuel and hence, less output of pollutants.

A number of tests were conducted with and without device 12 installed on a variety of both foreign and U.S. cars and these tests are reported in FIG. 18. The cars were all dynanmeter tested at an SCAC approved service center and mileage and performance reports were furnished by the car owners. Most owners reported quicker starting, improved torque and a smoother running motor at all speeds. Cars 2, 6, 7, 8 and 14 had new wires and plugs. Cars 1 and 11 had solid wire (static resistant cables). Cars 4, 9 and 10 had old wires. Ignition wires must be in good condition to carry the spark prolonger charge. Sorenson or Essex solid wire (static resistant cable) are recommended. The improvement in horsepower output of these cars was due to two factors: a) improved combustion within the firing chamber and b) corrected erratic combustion and misfiring. The reported average gas mileage increase of 16% can only be considered approximately. However, when these findings are coupled with the average increase in horsepower of 7.3%, a factual conclusion may be drawn that the improved combustion with device 10 results in increased torque, horsepower and mileage.

Figure 19:
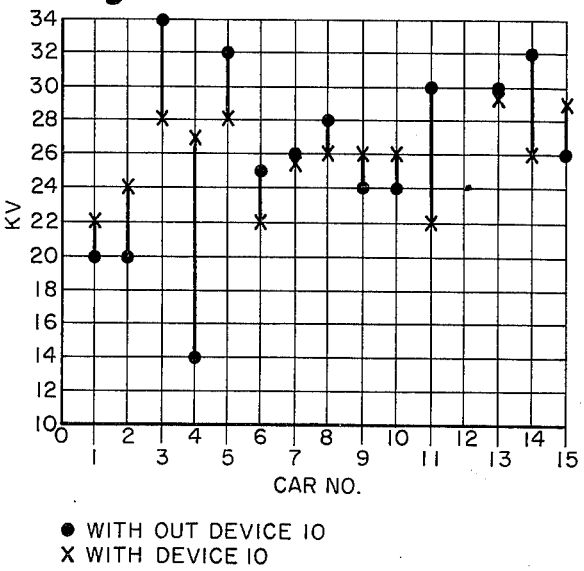
FIG. 19 is a plot of maximum spark voltages for the same vehicles with and without the invention installed.

FIG. 19 is a plot of maximum plug firing voltage (point B on FIG. 5) for the fourteen cars listed in the chart of FIG. 18, the O being without device 10 installed and the X being with the device 10 installed. The effect of device 10 is to bring the maximum firing voltages into a narrower band range as indicated by the range of approximately 22 and 30 KV for the X values versus a range of 14 to 34 KV for the O values. Thus, the device 10 has a positive modifying effect on the maximum firing voltage which could be in part responsible for the prolongation of the spark line C–D for different engines. The modifying effect is apparently due to the change in impedance of the complete system including the ignition coil and the device 10.

Figure 12:
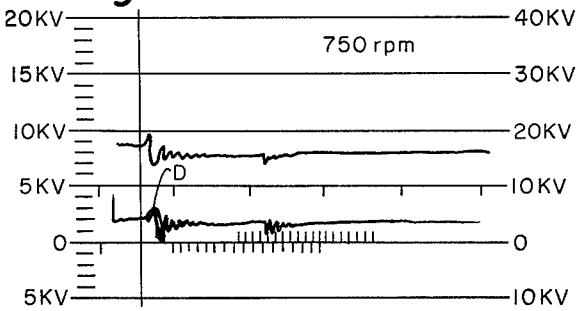
FIGS. 12, 13 and 14 are actual oscilloscope diagrams of the same engine equipped with a modified form of the invention utilizing a different gauge wire and operating at 750 rpm, 1800 rpm and 3500 rpm, respectively.
Figure 13:
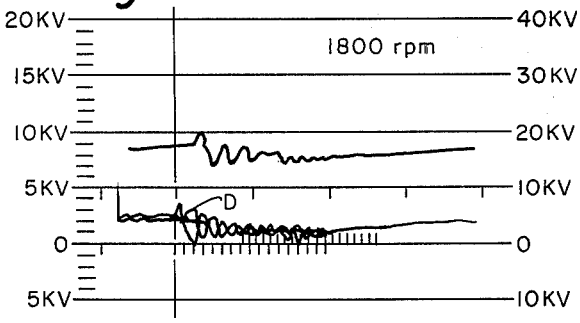
Figure 15:
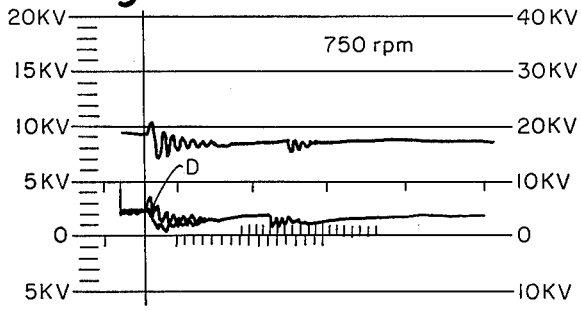
FIGS. 15, 16 and 17 are actual oscilloscope diagrams of the same engine equipped with a modified form of the invention utilizing twice as many coils and operating at 750 rpm, 1800 rpm, and 3500 rpm, respectively.
Figure 16:
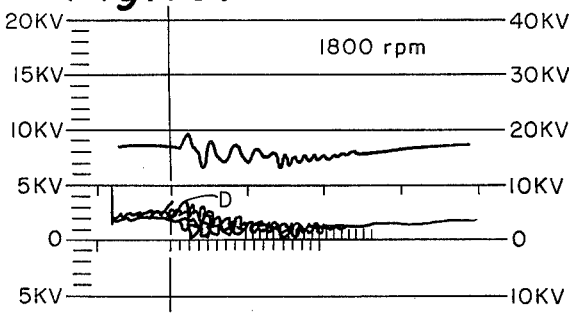
Figure 14:
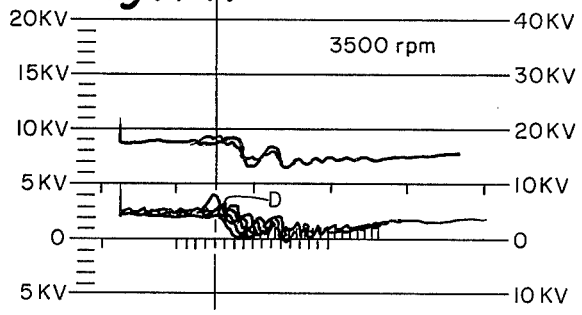
Figure 17:
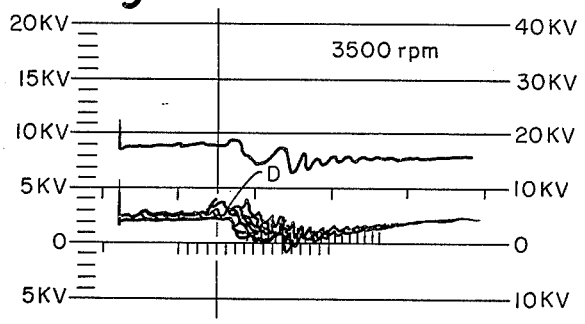

While 22 gauge wire was utilized in the device 10 for the test results, other wire sizes and winding patterns were also tested. FIGS. 12, 13 and 14 are the test results on Car 2 at 750, 1,800 and 3,500 rpm, respectively, with device 10 wound with 20 gauge wire. It is noted that the length of the line C–D in these figures is also prolonged over the same line of FIGS. 6, 7 and 8 without the device 10 installed. FIGS. 15, 16 and 17 are test results on Car 2 at 750, 1,800 and 3,500 rpm, respectively, when a second identical winding of 22 gauge wire was placed over a first winding of 22 gauge wire to provide twice as many windings on the core 16. At all speeds, the C–D line was extended over the line C–D produced without a device 10 installed. The vertical lines in FIGS. 12 and 15, FIGS. 13 and 16 and FIGS. 14 and 17 correspond to the time value of point D in FIGS. 6, 7 and 8, respectively.

In general, it appears that the wire size and number of coils can be varied within limits without substantially affecting the prolongation of line C–D obtained with device 10. As the size of wire 20 increase, the current to the plugs would increase and it is important not to exceed a current flow which would damage the electrodes of the plugs over extended periods of operation of the engine. In general, it appears that when device 10 is installed, less energy remains to be dissipated after the firing of the spark plug since the firing occurs over a longer line C–D and more energy goes through the plug. Thus, more energy from the secondary of the ignition coil passes across the plug and less remains to be dissipated back into the ignition coil.

As previously discussed, the ratio of coil turns in the first, second and third sections of the second portion of the device is one to two to one. While the preferred number of turns for the first, second and third sections are 48-96-48, respectively, the number of turns can be varied. A second winding portion with coil turns of 40-80-40 was constructed with 24 gauge wire and was found to work satisfactorily. Also, coil turns of 50-100-50 for the first, second and third sections were found to work satisfactorily. Devices 10 with core diameters of 1 inch and 1½ inches wound with 24 gauge wire have operated satisfactorily. However, as previously stated, the preferred device has a core diameter of 1¼ inches and is wound with 22 gauge magnetic wire. The use of wood for the core is not as suitable as plastic since wood usually contains some moisture.

The prolonged flow of individual coil energy through the spark gap, as observed on actual oscilloscope patterns when the invention is installed, will produce a more efficient, smoother running motor with better performance. Tests have also shown that after spark prolonging device 10 is installed on used cars, it requires only 500 to 3,000 miles of driving (depending on motor condition) before the purging of removable carbon deposits is effected, after which many car motors run like new. It is not known why the device 10 removes carbon from the engine but it is only necessary to observe the exhaust to find that it contains carbon particles being blown out of the engine. It is possible that the output from device 10 neutralizes the positive charge on the carbon and causes it to release from the engine.

As indicated, the structure of device 10 can be varied without substantially affecting the action of the device. It is necessary that device 10 have a first winding portion coupled to a second winding portion consisting of three sections with the winding reversing between each of these sections. The device 10 is employed in a high voltage application since it is connected to the secondary of the ignition coil usually producing voltages in the range of 25KV.

What is claimed is:

1. An ignition spark prolong device located in the electrical line connecting the secondary winding of an ignition coil to the distributor comprising:

a core of electrically inert material;

an insulated wire conductor wound around said core and connected at one end to said secondary winding and at the other end to said distributor;

the end of said conductor connected to said secondary winding being wound into a first winding portion along said core in coils of wire spaced apart;

the other end of said first portion being connected to a first section of a second winding portion wound along said core in the same direction as said first portion in coils closely adjacent one another;

a second section of said second winding portion connected to the end of said first section and wound in a reverse direction from said first section along said core in closely adjacent coils; and a third section of said second winding portion connected to the end of said second section and wound in a reverse direction from said second section along said core in closely adjacent coils;

the wire conductor at the end of said third section being connected to said distributor.

2. In a device as defined in claim 1;

said core being constructed of a plastic material in the form of a solid cylindrical rod.

3. In a device as defined in claim 1;

said first and third sections of said second winding portion being of approximately the same length along said core and having approximately the same number of coil turns.

4. In a device as defined in claim 3;

said second section of said second winding portion being approximately twice the length of said first and third sections along said core and having approximately twice the number of coil turns as said first and third sections.

5. In a device as defined in claim 4;

said first winding portion having approximately ⅓ the number of coil turns and having approximately the same length along said core as said first and third sections.

6. In a device as defined in claim 1;

wherein the size of said wire conductor falls within the approximate range of 20 to 24 gauge.

7. In a device as defined in claim 2;

wherein said core has a diameter falling within the approximate range of 1 to 1½ inches.

8. In a device as defined in claim 6;

the ratio of coil turns in said first, second and third sections of said second winding portion being approximately one to two to one.

9. In a device as defined in claim 8;

wherein the size of said wire conductor falls within the approximate range of 20 to 24 gauge; and said core has a diameter falling within the approximate range of 1 to 1½ inches.

10. In a device as defined in claim 9;

wherein said first and third sections have 48 coil turns each and said second section has 96 turns.

11. In a device as defined in claim 10;

wherein said core diameter is 1¼ inches and said wire conductor is 22 gauge.

12. In a device as defined in claim 11;

wherein said first winding portion contains 15 coil turns.

13. In a device as defined in claim 12;

said core being approximately 6½ inches in length.

14. In a device as defined in claim 13;

wherein said first portion and said first and third sections each extend approximately 1¼ inches along said core and said second section extends approximately 2½ inches along said core.

15. In a device as defined in claim 1;

a first post projecting outwardly from said core between said first portion and said first section, a second post projecting between said first section and said second section and a third post projecting between said second section and said third section;

said wire conductors being reversed in direction about both said second and third posts.

* * * * *